US010686237B2

(12) United States Patent
Arnold et al.

(10) Patent No.: US 10,686,237 B2
(45) Date of Patent: Jun. 16, 2020

(54) CHANNEL FILTER WITH ADJUSTABLE FREQUENCY

(71) Applicant: Tesat-Spacecom GmbH & Co. KG, Backnang (DE)

(72) Inventors: Christian Arnold, Backnang (DE); Jean Parlebas, Burgstetten (DE)

(73) Assignee: Tesat-Spacecom GmbH & Co. KG (DE)

( * ) Notice: Subject to any disclaimer, the term of this patent is extended or adjusted under 35 U.S.C. 154(b) by 104 days.

(21) Appl. No.: 15/865,816

(22) Filed: Jan. 9, 2018

(65) Prior Publication Data

US 2018/0205127 A1 Jul. 19, 2018

(30) Foreign Application Priority Data

Jan. 16, 2017 (DE) ..... 10 2017 100 714

(51) Int. Cl.
*H01P 1/208* (2006.01)
*H01P 7/06* (2006.01)

(52) U.S. Cl.
CPC ..... *H01P 1/208* (2013.01); *H01P 7/06* (2013.01)

(58) Field of Classification Search
CPC ..... H01P 1/208; H01P 7/06
USPC ..... 333/227, 231–233
See application file for complete search history.

(56) References Cited

U.S. PATENT DOCUMENTS 2,742,617 A 4/1956 Bondley
4,761,625 A 8/1988 Sharma
5,070,313 A * 12/1991 Gladh ..... H01P 7/10 333/202
9,041,488 B2 * 5/2015 Arnold ..... H01P 1/207 333/135
2011/0298566 A1 12/2011 Yassini et al.
2016/0064790 A1 3/2016 Arnold et al.

FOREIGN PATENT DOCUMENTS

EP 2991158 A1 3/2016

* cited by examiner

*Primary Examiner* — Robert J Pascal
*Assistant Examiner* — Kimberly E Glenn
(74) *Attorney, Agent, or Firm* — Lerner, David, Littenberg, Krumholz & Mentlik, LLP

(57) ABSTRACT

A resonator for a channel filter is provided. The resonator includes a cavity; a sidewall which at least partially surrounds and forms the cavity, wherein at least one lateral opening is provided in the sidewall; a first adjusting unit with an adjusting element. A first recess is provided at the adjusting element. The adjusting unit is arranged such that the adjusting element adjoins the lateral opening. The adjusting element is movable relative to the lateral opening such that a resonator frequency of the resonator can be adjusted depending on a position of the adjusting element with reference to the lateral opening.

16 Claims, 2 Drawing Sheets

CHANNEL FILTER WITH ADJUSTABLE FREQUENCY

FIELD OF THE INVENTION

The present description relates to a resonator for a channel filter and to a channel filter for a communication arrangement or for a data transmission link, in particular for a satellite transmission link, in particular for a satellite radio transmission link.

The satellite radio transmission link may be, for example, a Ka-band transmission link having a frequency range of 17.7 to 21.2 GHz for the downlink and 27.5 to 31 GHz for the uplink, a Ku- or X-band implementation in the range of 11 or 7 GHz, respectively, or a L-band (about 1.5 GHz), S-band (about 2.5 GHz), or C-band implementation (about 4 GHz).

BACKGROUND OF THE INVENTION

Resonators may be a passive component that is used as a channel filter in radio transmission links (or radio transmission paths). Typically, channel filters used in practice are comprised of multiple resonators that are coupled with each other. With an increasing frequency of the signal transmission of a radio link (radio path), the requirements of the filters vary or change. In particular, the requirements may relate to structural and spatial requirements as well as to requirements with regard to the effectively usable bandwidth of a filter. The effectively usable bandwidth is that frequency bandwidth for which a filter behavior about a central frequency is constant or almost constant.

Depending on the resonance frequency of a filter, it is typically required to adapt the geometric dimensions of a filter, for example.

Typically, channel filters are used to filter the desired signal from a broad frequency spectrum. These channel filters typically have a fix center frequency and a fix bandwidth. However, as a certain flexibility of the bandwidth is often requested, it is desirable to have adjustable resonators.

EP 2 991 158 A1 and US 2016/0064790 A1 describe a channel filter with an adjusting element designed as an adjusting disk. Thereby, adjusting the resonance frequency is enabled throughout a large range and in small steps. However, apart from highly precise actuators, a corresponding control is required for adjusting. In particular for aerospace applications, this may be very expensive.

For example, channel filters may be utilized in so called output multiplexers. A typical output multiplexer is comprised of channel filters that are connected to a waveguide busbar system. A function of the output multiplexer is to combine small-band communication signals onto a common waveguide (the so-called busbar system). Typically, the channel filters and the busbar are adjusted to each other in a costly design process. Furthermore, the individual components for the channel filters as well as the busbar and possibly required additional components can be ordered and manufactured only after finishing this design process.

BRIEF SUMMARY OF THE INVENTION

There may be a need for a resonator for a channel filter which allows an easy adjusting of its resonator frequency.

According to a first aspect, a resonator for a channel filter is provided. The resonator comprises a cavity, a side wall, and a first adjusting unit with an adjusting element. The side wall surrounds the cavity at least partially and thereby forms the cavity. At least one lateral opening is provided in the side wall. A first recess is provided at the adjusting element, wherein the adjusting unit is arranged such that the adjusting element adjoins the lateral opening and wherein the adjusting element is movable relative to the lateral opening such that a resonator frequency of the resonator can be adjusted depending on a position of the adjusting element with reference to the lateral opening.

The resonator comprises a cavity which is shaped like a hollow cylinder, for example. In other words, the cavity represents a hollow space. This cavity is laterally shaped or limited by the side wall. Typically, the side wall limits or encompass the cavity completely or partially. For example, a resonator may be made of two half shells. A first lower half shell contains the cavity, and a second upper half shell closes the cavity. The second half shell may be referred to as lid. The cavity is formed in the lower half shell and is limited by a bottom area and the partially or completely surrounding or encompassing side wall.

The shape and the volume of the cavity influence the resonator frequency of the resonator. Generally speaking, in case one wants to adapt the resonator frequency, the shape of the cavity may be varied by, for example, moving a part of the side wall or by moving a so called adjusting disk by an adjusting screw so that the shape or the geometric design of the cavity changes.

In the present case, it is provided that at least one lateral opening is provided in the side wall of the cavity, and a moveable adjusting element is arranged thereon. The adjusting element comprises at least one recess. Preferably, the adjusting element is arranged such that it is moved along a tangential direction of the cavity or of the side wall. The recess can be selectively brought into an overlap position with the lateral opening or can be moved away therefrom, so that another region of the surface of the adjusting element (or another recess) is brought to overlap with the lateral opening or covers the lateral opening. Thus, the volume and also the shape of the cavity changes, and also the resonator volume changes, so that also the resonator frequency is changed.

Preferably, the lateral opening is substantially closed in any position of the adjusting element and the recess forms a lateral extension (enlargement, widening) of the cavity. The adjusting element may also be in a position in which no recess is positioned at the lateral opening. In this case, the lateral opening is closed flush by a surface of the adjusting element. Anyway, in case a recess is arranged at the lateral opening, the volume of the cavity is larger in comparison to a position of the adjusting element in which no recess adjoins the lateral opening. Hence, the resonator frequency is also different in these two states, like it is different when recesses with different dimensions are positioned at the lateral opening.

The adjusting element which may be formed as an adjusting cylinder, for example, may comprise a single recess which may be moved towards the cavity or away therefrom, or which can be rotated. However, the adjusting element may also be an elongated rod-shaped element on which differently deep grooves or slots (i.e., recesses) are arranged, of which grooves the desired one is shifted into position, i.e., is brought to overlap with the lateral opening.

According to an embodiment, a second recess is provided at the adjusting element, which second recess can be brought to overlap with the lateral opening by moving the adjusting element.

Hence, at least two options exist for adjusting the resonator volume. Thus, also at least two different resonator frequencies can be set, namely those resonator frequencies which result from the two different recesses in addition to that resonator frequency which results if none of the two recesses is brought to overlap with the lateral opening.

Bringing a recess to overlap with the lateral opening means that the adjusting element is brought to a position in which a recess overlaps or covers the lateral opening. Preferably, the complete or entire lateral opening is overlapped by the recess in this position and the edges of the lateral opening are contacted by the edges of the recess, so that the adjusting element closes the cavity but, however, changes its volume and geometry.

For example, a recess as described herein is a recess or a groove in a surface or in a surface region or surface area of the adjusting element. Preferably, the shape of this recess at the surface of the adjusting element corresponds to the shape of the lateral opening. From a perspective viewing to the surface of the adjusting element (perpendicular to the surface), the recess may be shaped like a rectangle, for example, and the lateral opening is likewise shaped like a rectangle, preferably with edges of the same length.

According to a further embodiment, a depth of the first recess differs from a depth of the second recess.

Thereby it is enabled that the cavity may be extended by different volumes, so that different resonator frequencies are possible.

According to a further embodiment, the adjusting element is a cylindrical body and the first recess is a recess in radial direction of the cylindrical body.

Preferably, the cylindrical body is made of a solid material. Hence, the cylindrical body is not a hollow body like a pipe, for example. The recess is a groove in the surface in radial direction and extends at the surface in axial direction as well as in circumferential direction.

According to a further embodiment, the first recess has a rectangular cross section.

This means that the side walls of the recess are parallel to each other and are in a right angle with respect to a bottom area of the recess, for example. The corners of the recess may be rounded.

In a further embodiment, the recess may have a cross section of another shape, for example semicircular.

According to a further embodiment, the adjusting element is rotatable about an axis of rotation, so that the first recess is moveable with respect to the lateral opening.

In other words, the adjusting element does not change its absolute position in this embodiment if the axis of rotation coincides with a middle axis of the cylindrically shaped adjusting element. The adjusting element changes only its orientation This may contribute to a space-saving construction as no installation space must be provided for enabling a transversal movement of the adjusting element.

According to a further embodiment, the adjusting unit comprises an actuator. The actuator is arranged to move or to rotate the adjusting element to a desired position.

According to a further embodiment, the actuator is a motor with an axis of rotation, wherein the axis of rotation may be adjusted in a stepwise manner to adopt at least two different angular positions.

Thus, the adjusting element may be rotated about the axis of rotation and may be brought to a desired position with reference to the lateral opening in a high precise manner. Because the adjusting element performs a rotational movement, less installation space is required in order to install the movable adjusting element.

The motor may be a stepper motor or a so called switch motor and is preferably electrically driven.

Preferably, the actuator is configured such that it adopts one of the at least two angular positions in response to a specific control signal and takes another angular position in response to another control signal. The angular positions may be fixedly given and relate to the orientation of the axis of rotation or rotor of the motor. The angular position may be indicated in an external coordinate system and describes the orientation of the rotor with reference to the cavity or with reference to a lateral opening.

According to a further embodiment, a further lateral opening is provided in the side wall, wherein the resonator comprises a second adjusting unit with an adjusting element, wherein a recess is provided at the adjusting element of the second adjusting unit and wherein the second adjusting unit is arranged such that the adjusting element of the second adjusting unit adjoins the further lateral opening.

The second adjusting unit may be structurally designed like the first adjusting unit which is described above and also with reference to the drawings. In this respect and related to the characteristics of the second adjusting unit, reference is made to the description of the first adjusting unit. Due to this design, the number of different resonator frequencies may be increased. The first adjusting unit and the second adjusting unit may be moved/rotated to a desired position independently of each other so that the volume of the resonator may be brought to a specific frequency value of the entire number of possible frequency values.

For the sake of completeness, it is noted that the resonator may also comprise more than two adjusting units. The number of adjusting units is merely limited by the available installation space and may be defined such that a desired number of different resonator frequencies may be provided.

The number of different resonator frequencies depends on the number of adjusting units and the number of different recesses per adjusting element. For example, four different resonator frequencies can be adjusted with two adjusting elements in case each of the adjusting elements has two different recesses. In case each adjusting element has three different recesses, nine different resonator frequencies can be provided. Of course, hybrid forms are also possible, in which the adjusting elements have a different number of recesses. However, it may be preferred that the adjusting elements are designed in a similar manner.

According to a further embodiment, the cavity is cylindrically shaped and the first adjusting unit and the second adjusting unit are arranged in a circumferential direction at the side wall.

According to another aspect, a channel filter for a communication arrangement is provided. The channel filter comprises at least one resonator as described above and hereinafter.

According to an embodiment, the resonator is coupled with a busbar by means of a wave guide section.

The channel filter may comprise multiple resonators, of which two or more resonators are connected in series, respectively, and are coupled with the busbar via the same wave guide section.

In other words, the resonator may be described as follows:

In order to enable adjustability of the channel filter, existing hardware with low complexity may be used, especially such hardware that is already used in outer space and that does not require new control means. So called wave guide switches can be used for this purpose. A wave guide switch is provided with a particular rotor, so that depending on the rotor position a variable short circuit (a recess that is brought to overlap with the lateral opening) with different lengths is connected in parallel to the channel filter. Thus, adjusting the resonator frequency in discrete steps is enabled. The number of different adjusting positions or settings depends on the number of variable short circuits implemented in the rotor.

By increasing the number of switching rotors (adjusting elements), the number of discrete settings may be increased. It generally applies that $a=n^m$, wherein a is the number of settings, n is the number of switching rotors, and m is the number of short circuits per switching rotor. For example, with two switching rotors with two short circuits, respectively, four discrete different resonator frequencies may be set.

BRIEF DESCRIPTION OF THE DRAWINGS

In the following, exemplary embodiments are described in more detail with reference to the attached drawings. The drawings are schematic and not to scale. Same reference signs refer to same or similar elements. It is shown in.

DETAILED DESCRIPTION

Figure 1:
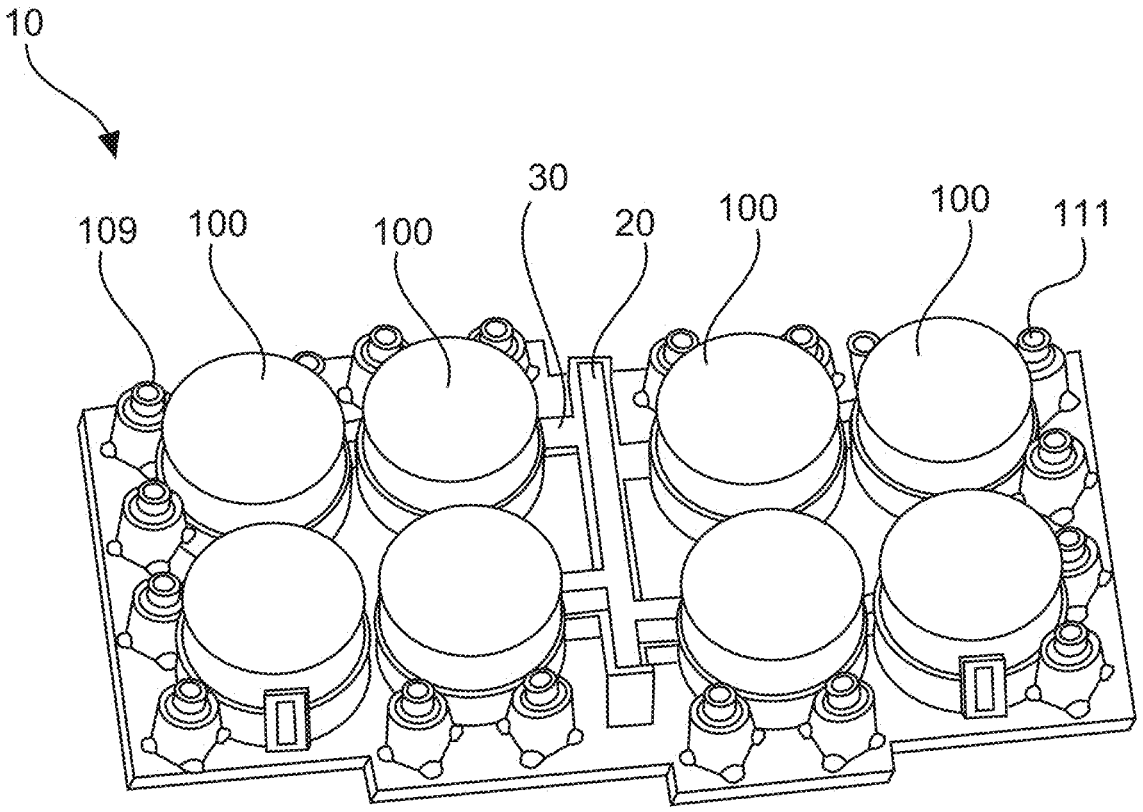
FIG. 1 a schematic representation of a channel filter according to an exemplary embodiment.

FIG. 1 shows a channel filter 10. The channel filter comprises a busbar 20. On each side (left, right in the representation), four resonators 100 are shown, respectively. Two resonators are connected in series, respectively, and are connected with the busbar 20 via a wave guide section 30. Based on its function, the busbar 20 may also be referred to as waveguide because the busbar is adapted to conduct or transmit a signal.

The structure of a resonator 100 can also be derived from FIG. 1. In this example, each resonator comprises two adjusting units 109, i.e., two adjusting units 109 are assigned to each resonator, respectively. Each of the adjusting units 109 comprises an adjusting element (not shown in FIG. 1) and an actuator 111. Here, the adjusting units 109 are arranged at the side walls of the resonators.

The resonator frequency of the resonators 100 is set to a certain value by adjusting a desired position of the adjusting elements. For this purpose, it is merely necessary that the actuators 111 bring the adjusting element into the corresponding position. Even though a rotational movement is necessary in FIG. 1, a transversal movement may basically also be used for this.

Figure 2:
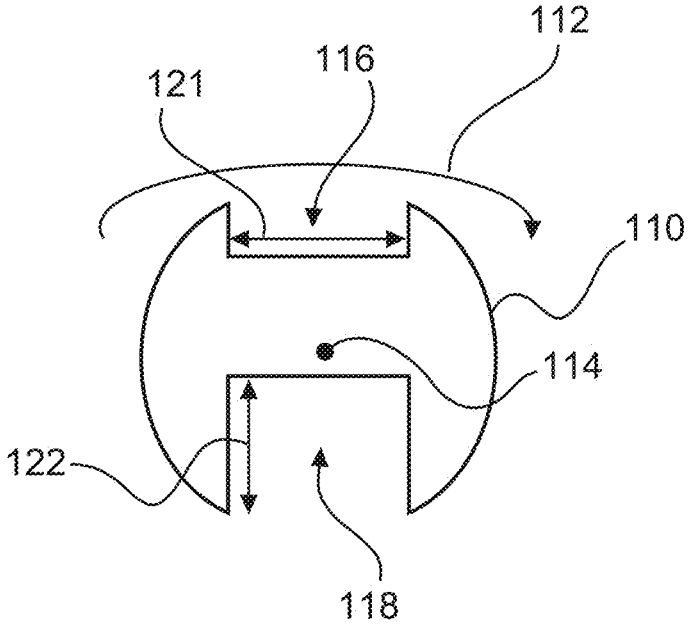
FIG. 2 a schematic representation of an adjusting element for a resonator according to a further exemplary embodiment.

FIG. 2 shows a schematic representation of an adjusting element 110. The adjusting element 110 is shown in a top view in axial direction and comprises two recesses 116, 118. Basically, the adjusting element is a cylindric body, wherein this shape is gradually changed by the recesses. The recesses are of a rectangular cross section, i.e., the side walls of a recess are perpendicular with respect to the related bottom area.

The adjusting element 110 is arranged so that it may be rotated about the axis of rotation 114, namely clockwise or counter clockwise, as indicated by arrow 112. The arrow 112 indicates an adjusting movement of the adjusting element.

Now, the adjusting element 110 may be rotated in a manner that the first recess 116 or the second recess 118 overlaps a lateral opening 106 of the cavity 102. However, intermediate positions are also possible, so that a surface of the adjusting element that is located between the recesses overlaps the lateral opening.

The recesses 116, 118 may be described with reference to their width 121, depth 122, as well as height. In FIG. 2, the height of the recesses protrudes from the plane of projection or reaches into it.

Both recesses 116, 118 have the same width 121 and the same height, as these two values are adapted to the size of the lateral opening. However, the recesses 116, 118 have a different depth 122. The volume of the resonator is differently influenced depending on which recess adjoins or overlaps the lateral opening of the resonator.

In this example, the first recess 116 has a lower depth 122 than the second recess 118. For the sake of simplicity, the case in which the first recess 116 overlaps the lateral opening shall be referred to as position 1 and the other case in which the second recess 118 overlaps the lateral opening shall be referred to as position 2, wherein in case of a rotational movement the positions especially indicate an orientation or an angular position of the adjusting element 110.

Figure 3A:
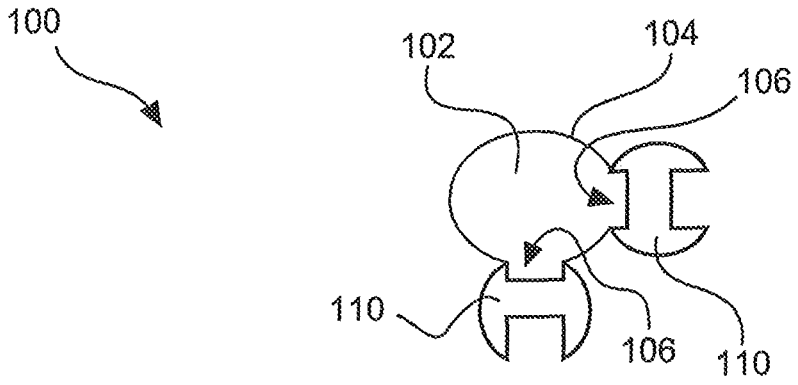
FIGS. 3A-3C schematic representations of a resonator in different configurations according to a further exemplary embodiment.
Figure 3B:
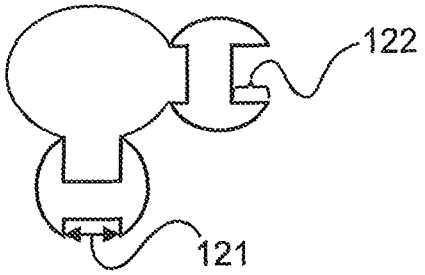
Figure 3C:
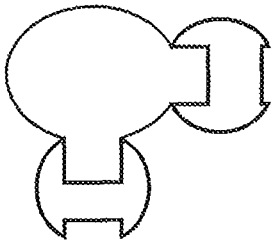

With reference to FIGS. 3A-3C, possible settings of the resonator frequency are depicted with reference to the positions of the two adjusting elements, wherein for the sake of simplicity only one cavity 102 with two lateral openings 106 (left and bottom) and two adjusting elements 110 (left and bottom, arranged at the corresponding lateral opening, respectively) are shown here. The adjusting element on the left is referred to as adjusting element 1 and the adjusting element at the bottom is referred to as adjusting element 2.

In FIG. 3A, both adjusting elements are in position 1, i.e., the two smaller recesses overlap or cover the lateral openings 106, respectively.

In FIG. 3B, adjusting element 2 is in position 2 and adjusting element 1 is in position 1. Basically, this constellation may be equivalent to that case in which adjusting element 2 is in position 1 and adjusting element 1 is in position 2, i.e. the positions are interchanged. In other words, the volume of the cavity is varied by the same value, independently of which adjusting element is in position 1 or position 2. However, it may also apply that the resonance frequency is influenced in a different manner depending on the position of the adjusting elements 110 at the resonator.

In FIG. 3C, both adjusting elements are in position 2, i.e., the volume of the cavity is extended to its maximum.

It may be seen in FIGS. 3A-3C that totally four constellations are possible for the position or orientation of the adjusting elements (two adjusting elements, two positions, respectively, $2^2=4$), wherein two constellations result in an equal volume extension of the cavity, wherein the adjusting elements are arranged at different positions with reference to the resonator, see explanations of FIG. 3B. The possible constellations and the impacts on the volume extension may be taken from the following table, wherein the case where no recess overlaps the lateral opening is not considered here.

| | Position adjusting element 1 | Position adjusting element 2 | |
|---|---|---|---|
| Constellation 1 | 1 | 1 | Minimum volume |
| Constellation 2 | 1 | 2 | intermediate stage |
| Constellation 3 | 2 | 1 | like constellation 2 |
| Constellation 4 | 2 | 2 | Maximum volume |

Figure 4:
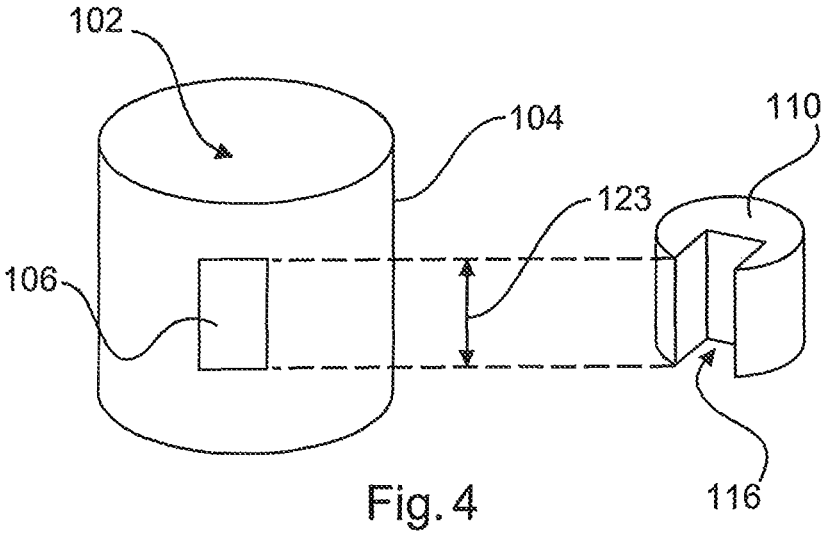
FIG. 4 a schematic representation of a resonator according to a further exemplary embodiment.

FIG. 4 shows a schematic isometric representation of a cavity including side wall 104 and lateral opening 106. Besides, an adjusting element 110 with a recess 116 is shown. The recess 116 has a width and a height which are adapted to the dimensions of the lateral opening 106. The depth (in radial direction of the adjusting element 110) may be chosen freely in order to indirectly influence the resonance frequency by varying the volume of the cavity 102.

The height 123 of the lateral opening 106 may extend along a part of the side wall or along the entire height of the side wall. Likewise, the recess 116 may extend in axial direction of the adjusting element 110 over the entire length of the adjusting element or only over a part of the axial length of the adjusting element. Even though the recess can be seen at the two end faces (top and bottom) of the adjusting element in FIG. 4, the recess 116 may be designed such that it closes the top edge and the bottom edge of the lateral opening 106 in a flush manner if the recess 116 overlaps the lateral opening 106.

Additionally, it is noted that "including" or "comprising" does not exclude any other elements and "a" or "an" does not exclude a plurality. It is further noted that features or steps which are described with reference to one of the above exemplary embodiments may also be used in combination with other features or steps of other exemplary embodiments described above. Reference signs in the claims are not to be construed as a limitation.

LIST OF REFERENCE SIGNS

10 channel filter
20 busbar, waveguide
30 wave guide section
100 resonator
102 cavity
104 side wall
106 opening
109 adjusting unit
110 adjusting element
111 actuator
112 adjusting movement
114 axis of rotation
116 first recess
118 second recess
121 width of the recess
122 depth of the recess
123 height of the recess While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A resonator for a channel filter, comprising:
a cavity;
a side wall which at least partially surrounds and forms the cavity, wherein at least one lateral opening is provided in the sidewall;
a first adjusting unit with an adjusting element;
wherein a first recess is provided at the adjusting element;
wherein the adjusting unit is arranged such that the adjusting element adjoins the lateral opening and extends radially outward from the side wall;
wherein the adjusting element is movable relative to the lateral opening such that a resonator frequency of the resonator is configured to be adjusted depending on a position of the adjusting element with reference to the lateral opening, wherein a volume of the first recess is additive to a volume of the cavity.

2. The resonator of claim 1, wherein a second recess is provided at the adjusting element, wherein the second recess is configured to overlap with the at least one lateral opening by moving the adjusting element.

3. The resonator of claim 2, wherein a depth of the first recess differs from a depth of the second recess.

4. The resonator of claim 2, wherein a height and a width of the second recess corresponds to a height and a width of the at least one lateral opening, respectively.

5. The resonator of claim 2, wherein a height and a width of the second recess is the same as a height and a width of the first recess, respectively.

6. The resonator of claim 1, wherein the adjusting element is a cylindrical body and wherein the first recess is a recess in radial direction of the cylindrical body.

7. The resonator of claim 6, wherein the first recess has a rectangular cross section.

8. The resonator of claim 6, wherein the adjusting element is rotatable about an axis of rotation so that the first recess is moveable with respect to the at least one lateral opening.

9. The resonator of claim 8, wherein the axis of rotation is outside the cavity.

10. The resonator of claim 1, wherein the adjusting unit comprises an actuator which is arranged to move the adjusting element into a desired position.

11. The resonator of claim 10, wherein the actuator is a motor with an axis of rotation, wherein the axis of rotation can adopt at least two different angular positions in a stepwise manner.

12. The resonator of claim 1, wherein the at least one lateral opening comprises a first lateral opening and a second lateral opening provided in the side wall;
wherein the resonator comprises a second adjusting unit with an adjusting element, wherein a recess is provided at the adjusting element of the second adjusting unit; and
wherein the second adjusting unit is arranged such that the adjusting element of the second adjusting unit adjoins the second lateral opening.

13. The resonator of claim 12, wherein the cavity is cylindrically shaped and the first adjusting unit and the second adjusting unit are arranged in a circumferential direction at the side wall.

14. A channel filter for a communication arrangement, the channel filter comprising at least one resonator of claim 1.

15. The channel filter of claim 14, wherein the resonator is coupled with a busbar by a wave guide section.

16. The resonator of claim 1, wherein a height and a width of the first recess corresponds to a height and a width of the at least one lateral opening, respectively.

* * * * *